US006969581B1

(12) United States Patent
Wagner

(10) Patent No.: US 6,969,581 B1
(45) **Date of Patent: *Nov. 29, 2005**

(54) METHOD AND APPARATUS FOR RESTORING AND STABILIZING MOTION PICTURE FILM

(76) Inventor: George E. Wagner, 1740 N. Avenue 53, Los Angeles, CA (US) 90042

( * ) Notice: Subject to any disclaimer, the term of this patent is extended or adjusted under 35 U.S.C. 154(b) by 0 days.

This patent is subject to a terminal disclaimer.

(21) Appl. No.: 10/874,952

(22) Filed: Jun. 23, 2004

(51) Int. Cl.[7] ..... G03C 5/28; G03C 7/46
(52) U.S. Cl. ..... 430/359; 430/361
(58) Field of Search ..... 430/359, 361

(56) References Cited

U.S. PATENT DOCUMENTS 3,643,569 A * 2/1972 Vary ..... 430/357
4,144,612 A * 3/1979 Yamaguchi ..... 15/208
4,717,646 A * 1/1988 Giorgi ..... 430/359
5,215,192 A * 6/1993 Ram et al. ..... 206/205
5,796,874 A * 8/1998 Woolfe et al. ..... 382/254
6,412,656 B1 * 7/2002 Placik ..... 221/33
6,537,737 B1 * 3/2003 Wagner ..... 430/359

FOREIGN PATENT DOCUMENTS

JP 63119385 * 5/1988

* cited by examiner

*Primary Examiner*—Hoa Van Le
(74) *Attorney, Agent, or Firm*—James E. Brunton, Esq.

(57) ABSTRACT

A method and apparatus for restoring to chemical stability motion picture film having an acetate base which is suffering, or which may begin to suffer, from the deterioration generally referred to as "vinegar syndrome." The method allows films to be treated and stabilized without applying a liquid to their surfaces and without immersing them in any liquid. Instead, vapors emitted from a specially prepared, heated chemical solution permeate the film base and begin chemical reactions which ultimately restore the film. The process can be used on film that has begun to deteriorate, or it can be used, as a preventative measure, on apparently healthy film.

12 Claims, 2 Drawing Sheets

METHOD AND APPARATUS FOR RESTORING AND STABILIZING MOTION PICTURE FILM

BACKGROUND OF THE INVENTION

1. Field of the Invention

The present invention relates generally to restoration of film. More particularly, the invention concerns a method and apparatus for the restoration and chemical stabilizing of acetate base motion picture films.

2. Discussion of the Prior Art

Motion pictures have come to represent an increasingly important aspect of our cultural heritage, and like other art forms, their preservation offers serious challenges to archivists. One of the most severe problems is the deterioration of acetate films due to the condition generally referred to as "vinegar syndrome."

First noticed in the 1950's in films stored at high humidity, "vinegar syndrome" is a progressively ruinous condition for which all acetate films are at risk. Acetate is an ester of cellulose which is produced with large quantities of acetic acid. An ester, by definition, is a substance that can be broken down by heating in the presence of a catalyst. This process is termed hydrolysis.

When acetate film begins to become hydrolysized, it undergoes a reductive change in its chemical make up, with dilute acetic acid forming on its surface, and a distinctive vinegar like smell emanating there from. This change begins slowly and proceeds exponentially with the increasing presence of acetic acid acting as an ever more powerful catalyst. Ultimately, the film is effectively destroyed.

Despite the problem of "vinegar syndrome", acetate film is usually considered the most proven archival storage medium for motion pictures. Earlier cinema, starting around 1895, was produced on nitrate film, a highly flammable, chemically unstable, yet strong and reliable (when new) film base. Because of the danger inherent in the handling and storage of nitrate film, attempts were made early in the twentieth century to create films that were non-flammable. Acetate films (based on acetic acid rather than nitric acid) were developed with this objective in mind. Early acetate films possessed notably less tensile strength than their nitrate counterparts. For this and other reasons, nitrate film was continuously used for both the production and exhibition of theatrical motion pictures until approximately 1950. Up to about 1950 acetate films were used primarily for home movies and to stock rental libraries for schools, churches, and homes.

In the late 1940's the Eastman Kodak Company developed an improved acetate film stock known as triacetate. The more complex molecular bonds of this film provided greater tensile strength and allowed this stock to replace nitrate base film in the field of theatrical motion pictures. Most of the surviving significant films of the nitrate era have been preserved on acetate film. Acetate film remains in use today for the filming of theatrical motion pictures.

It was initially thought that the improved acetate film would provide a long term, trouble free solution to the instability problems posed by nitrate film, but this proved to be not entirely true. "Vinegar syndrome" was often found to affect prints that had been subjected to "scratch treatments", that is, chemical processes designed to lighten or eliminate scratches on the film's emulsion or base. Then too, magnetic sound track films with their iron oxide coatings acting as a catalyst frequently became "vinegary". Finally, the condition surfaced in random well stored negatives and prints with no unusual history.

Essentially, acetate films are the product of a series of reactions that, in chemical terms, do not go to completion. This means that they represent a chemical balance, rather than a stable compound, and that balance can be upset. As time passes and films age, their chance of developing this imbalance increases.

As instances of "vinegar syndrome" have become more pervasive, various suggestions have been made to slow the condition's progress. However, in dealing with the problems of preventing or curing "vinegar syndrome", the prior art has failed to disclose or remotely suggest the novel processes of the present invention, and therefore, is generally irrelevant.

Archival practice is to store acetate films in low humidity conditions at low temperatures, but above freezing. This tends to slow, but not arrest, the progress of "vinegar syndrome". Archival film storage cans, made of plastic instead of metal (metal is considered a catalyst for the syndrome) and designed to allow the escape of acid fumes, have been brought into common use. Additionally, silica gel packs are often used to remove water from film, as water is the fuel of hydrolysis. Probably the most effective, generally accepted tool specifically designed to combat "vinegar syndrome" is Eastman Kodak's Molecular Sieve. Molecular Sieves are similar to silica gel packets and are placed in film cans to absorb water and acetic acid. While effective in slowing "vinegar syndrome", these products fail to return films to full stability.

SUMMARY OF THE INVENTION

It is an object of the present invention to provide a method and apparatus for restoring and stabilizing deteriorating film.

Another object of the invention is to provide a method and apparatus of the aforementioned character for effectively preventing the deterioration of film.

Another object of the invention is to either prevent or reverse the condition of acetate film known as "vinegar syndrome."

A particular object of the invention is to extend the useful life of motion picture films, not merely for a short term, but for decades or longer.

By way of summary, the present invention comprises a process through which, by chemical treatment, motion picture films, both negative and positive, of any vintage, can be restored to reasonable stability and their useful life extended significantly. The identical process can be used for treating both diacetate (the acetate films before approximately 1950) and triacetate films. The ultimate result, in many cases, is a chemically stable film of great suppleness offering improved performance and greatly increased longevity.

DESCRIPTION OF THE INVENTION

Figure 1:
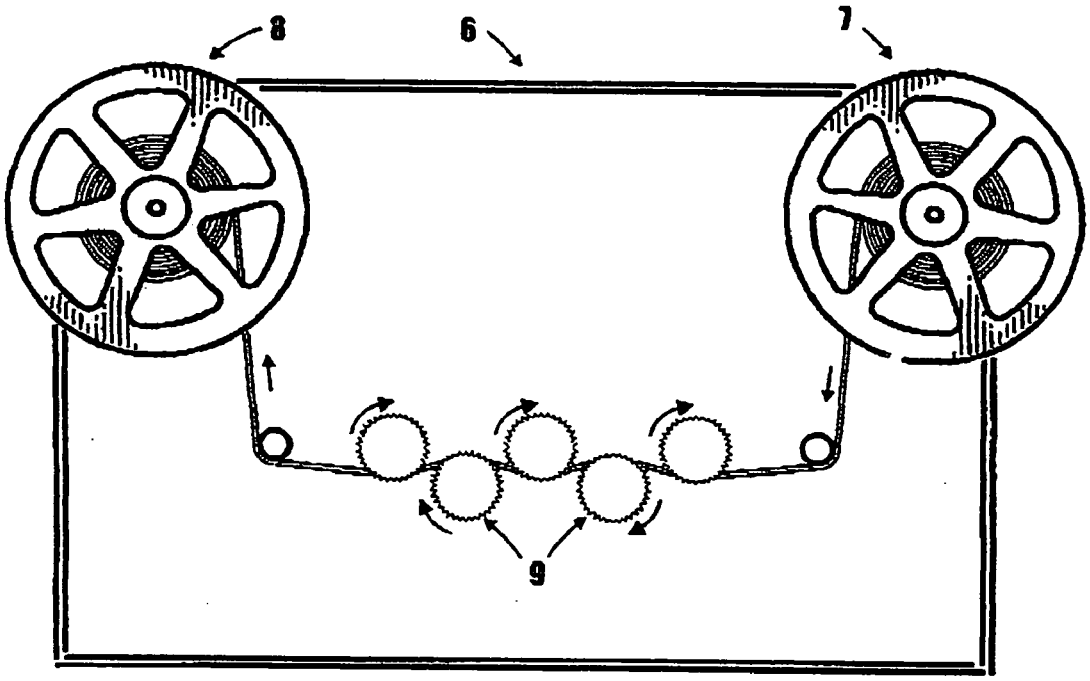
FIG. 1 is a side elevational view of one form of the assemblage of the apparatus for removing acetic acid and other moisture from the surface of the film.

Referring to the drawings and particularly to FIG. 1, one form of the assemblage of the apparatus of the invention for removing surface liquids and vapors from a motion picture film is there shown and designated by the numeral 6. The apparatus here comprises a feed reel 7 and a take-up reel 8 between which a series of rollers 9 surfaced with soft fabric wipers 9*a* are interposed. The purpose of the rollers is to remove any liquids or vapors residing externally on the motion picture film.

Figure 2:
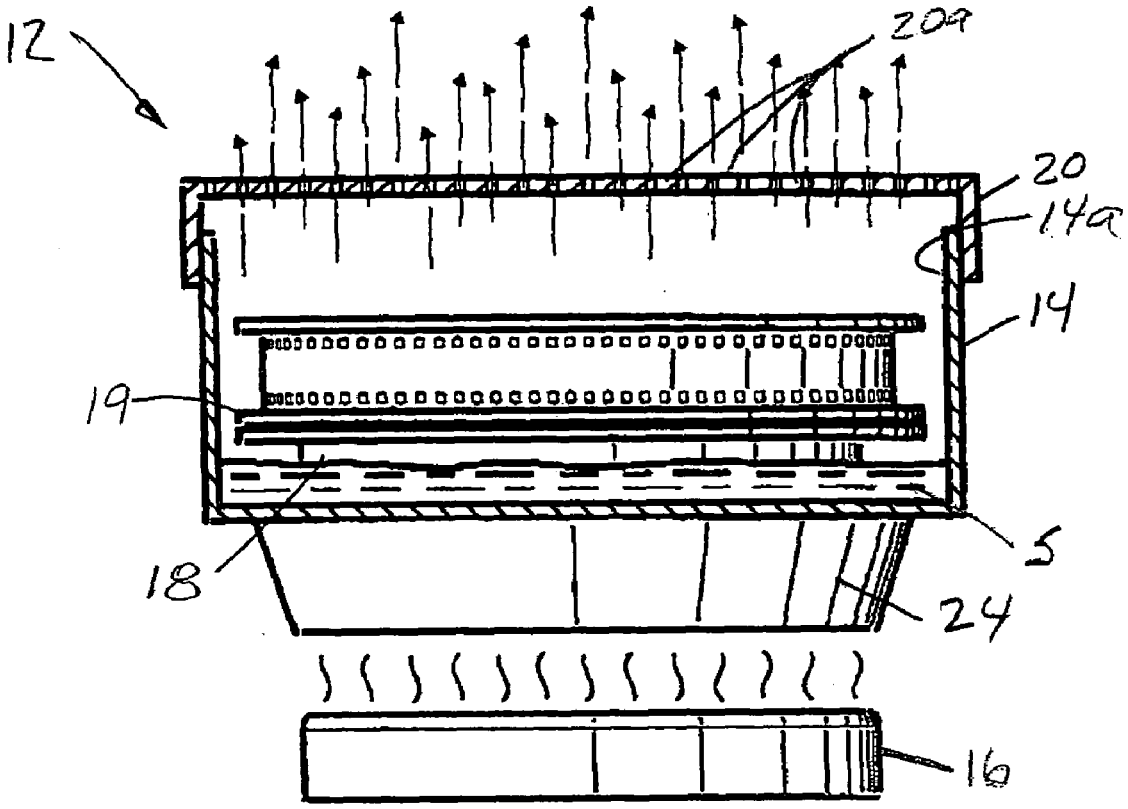
FIG. 2 is a side elevational cross-sectional view of one form of the assemblage of the apparatus for exposing the motion picture film to chemical vapors.

Referring particularly to FIG. 2 of the drawings, one form of the apparatus of the invention for exposing a motion picture film to chemical vapors is there shown and generally designated by the numeral 12.

This film exposure apparatus comprises a top open container 14 for containing a volatile solution "S", heating means for controllably heating the container to controllably heat the solution and support means for supporting the motion picture film above the container. The heating means here comprises a conventional heater or heating unit 16 that may be either electrically powered or may use flammable gases as a heating medium. The support means can take various forms but is here shown as a generally cylindrically shaped support member 18 that rests on the bottom of container 14 is partially immersed in the solution "S". As shown in FIG. 2, the film to be treated is loosely wound on a conventional house reel 19 that is supported on support member 18 in the manner shown in FIG. 2. Also forming a part of assemblage 12 is a cover 20 that is received over the open end 14*a* of container 14 in the manner shown in FIG. 2.

Before considering the method of the invention, a brief discussion of film deterioration would perhaps be helpful. It is, of course, fundamental that for a motion picture to retain its value it must remain in good physical condition. If a film is badly warped, reduced in weight and tensile strength, and is incapable of producing a steady, in focus image, its worth is reduced to almost nothing. If the film emulsion adheres to the base, causing image damage in winding, it likewise is essentially ruined. These are some of the long term effects of "vinegar syndrome", a deterioration of acetate film so devastating it has been compared to cancer. Indeed, it is similar in several ways, starting slowly and advancing exponentially until the film is destroyed. "Vinegar syndrome" is the water driven breaking down of the substance of film into its component parts. Over time the vinegar odor increases, the images are dimensionally distorted, and the film essentially evaporates.

The present invention comprises a method and apparatus for restoring film in the earlier stages of "vinegar syndrome" to a new, if now slightly different, chemical balance in a manner that is minimally invasive. In the past, film treatments done for various reasons have often involved immersion of the film in liquid baths contained within developer tanks or the like. These immersion techniques have frequently resulted in emulsion swelling, staining, physical tears to the base and similar problems. The present invention uniquely permits valued films to undergo chemotherapy in a safer way without requiring the immersion of the films in any liquid medium.

In carrying out one form of the method of the invention, a film, known to be degrading due to "vinegar syndrome", is first positioned on the film wiping means of the apparatus for removing moisture and chemical residue, such as acetic acid, from the surface of the film. In the present form of the invention this important film wiping means comprises the apparatus illustrated in FIG. 1 of the drawings. In using this apparatus, the film, is removed from a feed reel 7 by the action of a take-up reel 8 and is controllably moved across the series of powered soft cloth rollers or wipers 9. This operation, which can be performed one or more times depending on the advance of the film deterioration, removes surface deposits of acetic acid and its fumes, along with other moisture that may be present. The removal of these deposits by the rollers permits the chemical vapors of the second step of the method of the invention to more effectively penetrate the film. Preferably the removal of acid is accomplished immediately prior to the chemical treatment step. This surface acid removal is generally not necessary when treating healthy film as a preventative measure against "vinegar syndrome".

In further carrying out one form of the method of the invention, a selected mixture of chemicals is first placed into the metal container 14. These chemicals include glycerin (approximately six fluid ounces), ammonium phosphate (approximately ⅛th ounce), sodium sulfite (approximately ⅛th ounce), and zinc sulfate (approximately ½ ounce). The chemicals are stirred lightly to create a volatile chemical solution. This done, a metal spacer, such as support 18 is placed into container 14 and become the means for supporting the film to be treated. (An empty 16 mm 1600 feet or 2000 feet capacity metal film reel can be used for this purpose). It is important to note that during the chemical treatment step the film itself should make no direct contact with the chemical solution.

The film to be treated, which can be 35 mm or 16 mm, or other gauge, and up to 2000 feet in length, is wound rather loosely, and preferably base side out, onto a metal reel, such as reel 19 (in the case of 35 mm films, the heavy-duty reels intended for continuous theater use and known as "house reels" are ideal for this purpose). Reel 19 is then placed on a film supporting means for supporting the film. This film support means here comprises a support 18 which is positioned proximate container 14 in the manner shown in FIG. 2. This done, metal cover 20, which can be either solid or perforated with small holes 20*a* of about ⅛th inch in diameter is positioned over container 14. As mentioned, cover 20 is preferably apertured to allow the flow of chemical fumes generated when the volatile solution "S" is heated. Heating of the solution is accomplished by placing container 14 directly on top of a conductor member, such as case iron member 24 (FIG. 2) that is capable of producing an even, low level heat to the chemical mixture. Member 24 is, in turn, placed on the heating means or heating unit 16 that functions to supply an even, sustained heat to conductor member 24.

At intervals of about 20 to 25 minutes during the heating step, the top or lid is removed and checked for condensation. Excessive condensation on the lid can cause undesirable staining of the film. Therefore, any condensation on the lid should be wiped away with a towel or cloth several times, if necessary, during the heating step. 35 mm films should be turned over approximately half way through the treatment in order to better expose the entire width of the film to the chemical vapors. After about one hour and thirty minutes, reel 19 is removed from container 14. After about five to ten minutes of cooling at room temperature, the film that has been treated is removed from the house reel and wound onto another reel.

Because ammonia is a heart stimulant, and breathing heavy concentrations of ammonia can be dangerous, the method of the invention should be carried out in a well ventilated area, ideally with an exhaust fan placed directly above the heated mixture.

After the chemical treatment, or fuming step, the film can be returned to a protective can, or if conditions permit, can be loosely wound on a reel, and placed in an open space so that moisture can escape from the film by evaporation. Following this step, the film is returned to the protective can. In some cases, it may be desirable to place silica gel packets in the can with the treated film to reduce the film's moisture content. In dealing with individual films, there are many variables of the vinegar syndrome problem. After being treated each film, should be separately evaluated.

The method here described will not immediately remove all evidence of "vinegar syndrome" in all films. In some instances, the condition will have progressed to a point where repeated treatments over time may be indicated. In many instances, however, where the film deterioration is not far advanced, a single treatment can begin an internal process in the film base that will lead to a greatly restored, reasonably balanced result. Once this is attained, the long term prospects for the film's survival should be excellent, provided it is well stored. If necessary however, the chemical treatment can be repeated at any time.

Any conventional film type can be safely treated in this manner, including: Diacetate (Pre 1950 safety films), Triacetate (Post 1950 acetate safety film) black and white (negative or positive), Eastman Color (negative or positive), Kodachrome, and Technicolor Dye Transfer Prints.

The process brings about a change in the molecular structure inside the film base, rather than merely treating the symptoms of deterioration, (the most obvious being the vinegar like smell given off by affected film). The archivist is aided in making a determination of improvement by the fact that the chemicals employed are relatively odorless.

The various methods of the present invention can be accomplished in accordance with the examples which follow:

EXAMPLE 1

Several reels of a 35 mm fine grain positive of a black and white feature file of the 1950's is found to be emitting a vinegar like odor when the cans it is stored in are opened. To return the film to a balanced chemical state the archivist in charge elects to have the film treated by the means here described.

In accomplishing the method of this form of the invention, the selected film is placed on a reel and then onto the surface moisture removing apparatus illustrated in FIG. 1. After the removal of surface acid and other moisture by this apparatus, the film is wound rather loosely base side out, onto a metal reel, such as reel 19. Next selected chemicals are placed into the metal container 14 and are intermixed. This results in a formulation which comprises a volatile solution having the following components in the following relative proportions:

Between about 2 and about 12 ounces of glycerin; between about 1/14 and about 2 ounces of ammonium phosphate, between about 1/28 and about 2 ounces of sodium sulfite; between about 1/8 and about 3½ ounces of zinc sulfate, following the mixing of the components, reel 19 is placed on top of support 18 in the manner shown in FIG. 2. This done, metal cover 20 is positioned over container 14 and the heater means is activated to controllably heat the solution to an elevated temperature of between about 95 and about 150 degrees Fahrenheit to cause the solution to at least partially vaporize. The chemical fumes generated as the volatile solution vaporized are permitted to pass around and through the film so as to act upon the base in a manner to begin restoring it to a balanced state.

After exposure of the film to the chemical fumes for between about ten and about eighty minutes, the treated film is removed from the assemblage, allowed to cool, and wound onto another reel.

After 24 hours, the film is examined and it is observed that the vinegar like smell is greatly reduced. The film is then sealed in a can with silica gel packets to remove moisture. After a week, the can is opened and it is observed that no vinegar odor remains. It is also observed that the warp the film had developed has been greatly reduced.

EXAMPLE 2

A 16 mm Technicolor Dye Transfer positive print was found to be slightly warped and giving off a strong vinegar like odor. As in Example 1, surface moisture was removed from the film through the wiper roller device (FIG. 1) treatment in order to allow the chemicals to which the film was exposed in the second step of the method to better permeate the film. In further accomplishing the method of the invention, the dye transfer print was wound, base out, on a 2000 feet capacity 16 mm reel.

Next, the following components in the following proportions were intermixed within container 14:

Between about 2 and about 10 ounces of glycerin;

Between about 1/28 and about 2 ounces of ammonium phosphate;

Between about 1/14 and 1/4 ounces of sodium sulfite, and;

Between about 1/14 and 3½ ounces of zinc sulfate.

Following mixing of the components, reel 19 was placed on top of support 18 in the manner shown in FIG. 1. This done, metal cover 20 was positioned over container 14 with cover 20 in position, the assemblage was placed directly on top of a conductor member 38 and the heater means was activated. In this way the solution is controllably heated to an elevated temperature of between about 100 and about 150 degrees Fahrenheit in a manner to cause the solution to at least partially vaporize. The chemical fumes thus generated were then permitted to pass around, about and through the Technicolor film so as to act upon the base of the film to begin returning it to stability.

Following exposure of the film to the chemical fumes for between about ten and about ninety minutes, the treated film was wound onto a reel other than the one used to treat it, and the film was then returned to a protective can. After about 12 hours, the can was opened and though there was still a trace of vinegar smell, the film was much improved. The improvement continued automatically in the following days, aided by moisture removal by silica gel packets. The dye transfer images were unharmed.

EXAMPLE 3

Eastman Color

A 35 mm Eastman Color negative showed no evidence of "vinegar syndrome", but the film's producer elected to treat the film by the method there described as a preventative measure. As there were no significant acetic acid deposits on the surface of the film, the roller wiper step used in the previous examples was omitted. In accomplishing this latest method of the invention, the selected film was first wound, rather loosely, base out, onto reel 19. Next, the following components in the following relative proportions were intermixed within container 14:

Between about 4 and about 8 ounces of glycerin;

Between about 1/15th and about 1/4 ounce of ammonium phosphate;

Between about 1/16th and about 1/4 ounce of sodium sulfite;

Between about 1/16th and about 1/2 ounce of zinc sulfate;

Following mixing of the components, reel 19 was once again placed on top of support 18 in the manner shown in FIG. 2. This done, metal cover 20 was positioned over container 14. With cover 20 in position, the assemblage was placed directly on top of a conductor member 38 and the heater means was activated to controllably heat the solution to an elevated temperature of between about 105 and about 130 degrees Fahrenheit to cause the solution to at least partially vaporize. The chemical fumes generated were then permitted to pass around, about and through the Eastman color negative so as to act upon the base to add a protective measure of chemical stability. After exposure of the film to the chemical fumes for between about fifteen and about ninety minutes, the film was removed and returned to its original can.

The chemical blend described in the foregoing examples for the treatment of film can be modified or adjusted to obtain optimum results in various films. For instance, a film with more advanced vinegar syndrome having very significant odor and warp should be treated with higher amounts of ammonium phosphate and zinc sulfate, especially the latter. In addition, several chemicals can, if necessary, be substituted for zinc sulfate and accomplish similar results. These include powdered zinc metal (Zn), and zinc oxide ($Zn^{O}$).

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of restoring and chemically rebalancing film comprising in the subsequent step order the steps of:

(a) intermixing selected chemicals to form a volatile solution;

(b) wiping the film to remove therefrom surface deposits of moisture and acetic acid;

(c) heating said volatile solution to an elevated temperature sufficient to at least partially vaporize said volatile solution to create a vapor;

(d) exposing said film to said vapor to create a treated film.

2. The method as defined in claim 1 in which said selected chemicals are selected from the group consisting of glycerin, ammonium phosphate, sodium sulfite and zinc sulfate.

3. The method as defined in claim 1 in which said selected chemicals are selected from the group consisting of glycerin, ammonium phosphate, sodium sulfite, zinc sulfate, zinc metal powder and zinc compounds.

4. The method as defined in claim 1 in which said selected chemicals are selected from the group consisting of between about 4 and about 11 ounces of glycerin; between about 1/16 and 3/4 ounce of ammonium phosphate; between about 1/16 and 1/2 ounce of Sodium Sulfite;

and between about 1/10 and 3/4 ounce of zinc sulfate.

5. The method as defined in claim 1 in which said selected chemicals are selected from the group consisting of:

(a) Between about 4 and about 11 ounces of glycerin;

(b) Between about 1/15 and about 3/4 ounce of ammonium phosphate;

(c) Between 1/15 and about 1/2 ounce of sodium sulfite; and (d) Between about 1/10 and about 3/4 ounce of a zinc compound.

6. The method as defined in the claim 5 in which said zinc compound comprises zinc metal powder.

7. The method as defined in claim 5 in which said zinc compound comprises zinc oxide.

8. The method as defined in claim 1 in which said volatile solution is heated to an elevated temperature of between about 95 and about 150 degrees Fahrenheit.

9. A method of restoring physically deteriorating motion picture film comprising the steps of:

(a) wiping the motion picture film to remove therefrom surface deposits of moisture and acetic acid;

(b) preparing a volatile solution selected from the group consisting of glycerin, ammonium phosphate, sodium sulfite, and zinc sulfate;

(c) heating said volatile solution to an elevated temperature sufficient to at least partially vaporize said solution to create a vapor; and (d) exposing said motion picture film to said vapor to create a treated motion picture film.

10. The method as defined in claim 7 in which said group consists of between about 4 and about 11 ounces of glycerin; between about 1/16 and about 3/4 ounce of ammonium phosphate; between about 1/16 and about 1/2 ounce of sodium sulfite; and between about 1/16 and about 3/4 ounce of zinc sulfate.

11. The method as defined in claim 9 in which said volatile solution is heated to an elevated temperature of between about 105 and about 140 degrees Fahrenheit.

12. The method as defined in claim 9 in which the film is exposed to said vapor for between about ten and about ninety minutes.

* * * * *